United States Patent [19]

Erdman et al.

[11] 4,266,371

[45] May 12, 1981

[54] OPERATOR FOR A CASEMENT-TYPE WINDOW

[75] Inventors: Arthur G. Erdman, Roseville; Jeffory A. Peterson, Canby, both of Minn.

[73] Assignee: Truth Incorporated, Owatonna, Minn.

[21] Appl. No.: 41,722

[22] Filed: May 23, 1979

[51] Int. Cl.[3] ..... E05D 15/30

[52] U.S. Cl. ..... 49/252; 49/342

[58] Field of Search ..... 49/252, 250, 246, 342, 49/324, 208, 341, 343

[56] References Cited

U.S. PATENT DOCUMENTS

| | | | |
|---|---|---|---|
| 2,050,403 | 8/1936 | Weiner | 49/342 |
| 2,119,911 | 6/1938 | Fox-Williams | 49/342 |
| 2,298,158 | 10/1942 | Piron | 49/252 |
| 2,948,027 | 8/1960 | Gill, Jr. et al. | 49/252 |
| 3,085,299 | 4/1963 | Reynaud | 49/252 |
| 3,085,797 | 4/1963 | Anderberg et al. | 49/324 |
| 3,258,874 | 7/1966 | Martin | 49/252 |
| 3,457,675 | 7/1969 | Armstrong | 49/246 X |

*Primary Examiner*—Philip C. Kannan

*Attorney, Agent, or Firm*—Wegner, Stellman, McCord, Wiles & Wood

[57] ABSTRACT

An operator for a casement-type window having a sash mounted adjacent one edge thereof for combined pivoting and linear movement relative to a window frame with the operator having a member movably engaged with the sash adjacent an outer edge thereof for imparting opening and closing force to the sash. The operator includes linkage and gear structure connected to said member and operable in response to manual movement for moving said member in a path which closely approximates the movement of the sash outer edge to cause said member to always act adjacent the outer edge of the sash.

9 Claims, 4 Drawing Figures

OPERATOR FOR A CASEMENT-TYPE WINDOW

BACKGROUND OF THE INVENTION

This invention pertains to an operator for a casement-type window which always acts near a free outer edge of the window sash for improved action in opening and closing the window throughout the operating life of the operator.

A window of the general type to which the invention disclosed herein relates is shown in Gill U.S. Pat. No. 2,948,027. In such a window, the sash is mounted adjacent one edge at the top and bottom on slider structure whereby said edge of the sash has both combined linear and pivotal movements, along with pivotal movement of the sash. A constraining link is connected between the sash and the window frame for guiding the sash movement.

Many different structures are known for a casement-type window operator wherein a manually operated pivotal operating arm is either directly or indirectly connected to the window sash for causing opening and closing movement thereof.

One example of an operator for the casement-type window is shown in Reynaud U.S. Pat. No. 3,085,299 wherein a pivotal operating arm carries a member at an end thereof which moves along a track associated with the window sash during opening and closing movement of the window and with the movement of the member being in a curved path about the pivot axis of the operating arm. With such structure, the point of application of opening and closing force to the window sash changes, dependent upon the degree of window opening, and the mechanical advantage available to open the window is reduced with increased opening of the window.

SUMMARY OF THE INVENTION

A primary feature of the invention disclosed herein is to provide an operator for a casement-type window having an improved mechanical advantage in opening and closing the window resulting from the operator always acting at the outer edge of the window sash.

An object of the invention is to provide an operator for a casement-type window wherein a member is moved through a path corresponding to the path described by an outer edge of the window sash whereby said member always acts on the sash adjacent an outer edge thereof. With this structure, there is an improved mechanical advantage available for opening and closing the window.

Still another object of the invention is to provide an operator as defined in the preceding paragraph wherein the member is engageable within a channel member affixed to the sash and with there being only limited relative movement therebetween during opening and closing of the window whereby sliding friction losses are minimized.

Still another object is to provide an operator for a casement-type window wherein a member which acts on the sash is caused to follow a curved path which is a hypocycloid and which closely corresponds to the path of the outer edge of the window sash during opening and closing movements of the window whereby said member has very little movement relative to the sash during opening and closing of the window.

An added feature of the invention resides in the operator providing improved support of an open window sash against wind loading because of the interconnection of the member of the operator arm to the outer edge of the window sash.

DESCRIPTION OF THE PREFERRED EMBODIMENT

Figure 1:
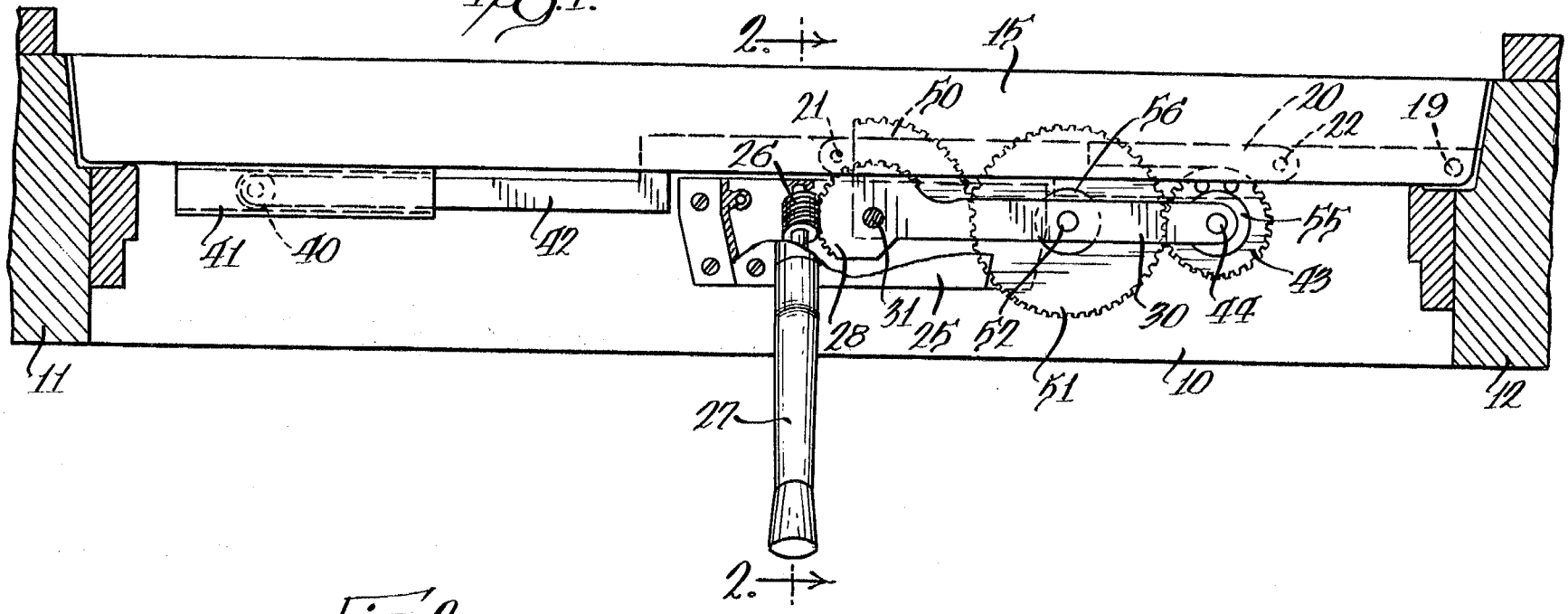
FIG. 1 is a plan section of a window showing the operator associated therewith with parts broken away and with the window sash shown in closed position.
Figure 2:
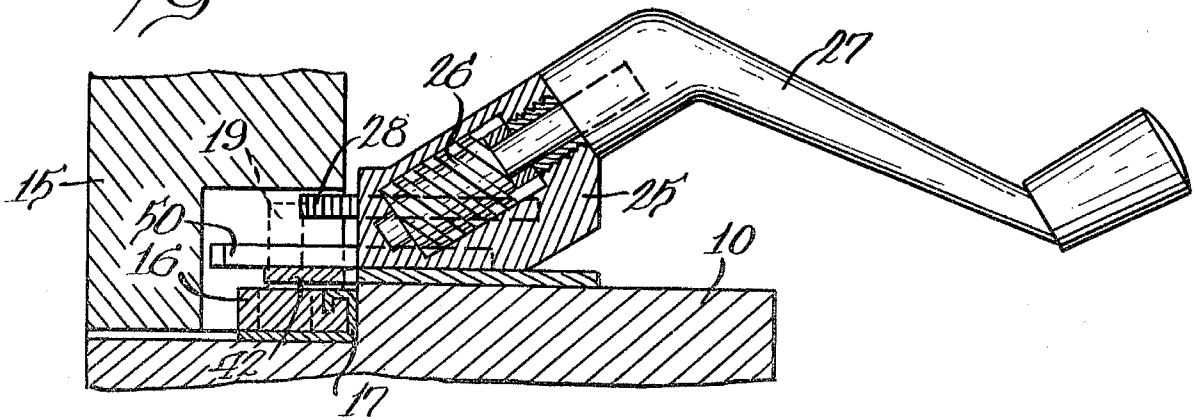
FIG. 2 is a vertical section, on an enlarged scale, taken generally along the line 2—2 in FIG. 1.
Figures 3, 4:
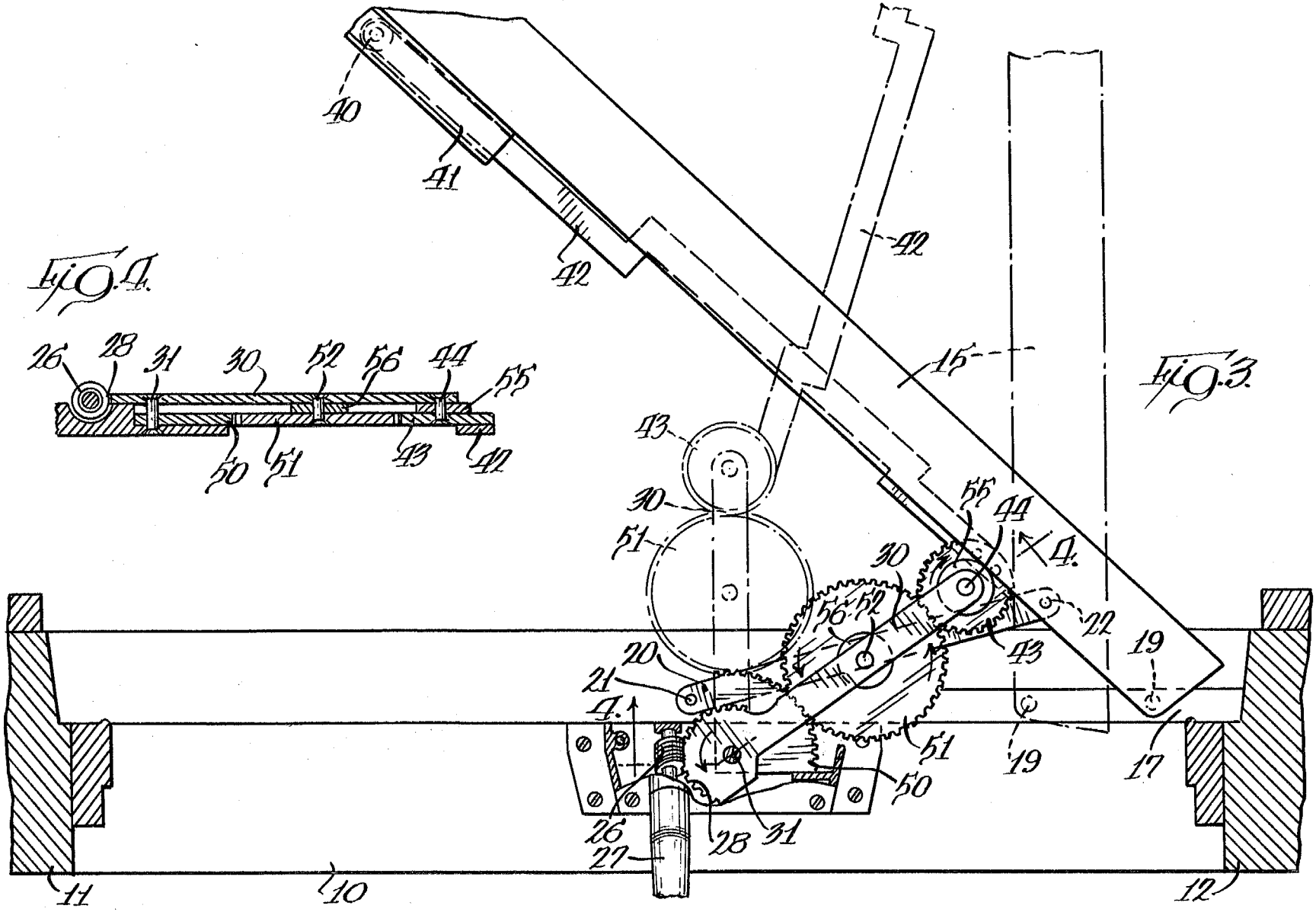
FIG. 3 is a view, similar to FIG. 1, showing the window sash partially open in full line and with the window sash fully open in broken line and with parts broken away.
FIG. 4 is a sectional view, taken along the line 4—4 in FIG. 3.

A casement-type window is shown generally in the drawings wherein a sill 10 has a pair of side jambs 11 and 12 at opposite ends extending upwardly therefrom. A window sash 15 is mounted within the frame for movement between the closed position, shown in FIG. 1, and the fully open position, shown in broken line in FIG. 3. The sash is mounted for opening and closing movement which consists of both pivoting and linear movement thereof by slider structure mounted at both the top and bottom thereof adjacent one edge of the sash. As shown in FIG. 2, a slider 16 is movable within a track 17 fitted to the window sill 10 and the slider pivotally supports the sash by connection thereto through a pivot pin 19. Structure of this type is more particularly shown and described in the aforesaid Gill patent and reference may be made thereto for a more detailed description of the slider structure and its connection to a window sash. Additionally, it is typical to have a constraining link 20 which extends between the window sill and the sash. As shown in FIG. 3, the constraining link is pivotally connected at 21 to the window sill and at 22 to the window sash. With the structure described, the window sash 15 can move from the closed position shown in FIG. 1 to a partially-open position shown in full line in FIG. 3, with the window sash movement being a combination of pivoting and linear movement and with the sash being capable of movement to a fully-open position shown fragmentarily in broken line in FIG. 3.

The operator for the window includes a housing 25 mountable on the window sill 10 and rotatably mounting a worm 26 rotatable by connection to a handle 27 and meshing with a worm wheel 28 formed integrally with an operating arm 30 which is mounted for pivotal movement on a pivot pin 31 within the housing 25. The operating arm moves from the retracted position, shown in FIG. 1, when the window is closed through an approximately 90° arc to an extended position shown in broken line in FIG. 3 when the window is fully open. This movement of the operating arm causes movement of a member 40 which is positioned within a channel member fixed to the window sash adjacent the outer edge thereof. This channel member 41 is secured to the lower rail of the window sash 15 and has its length extending lengthwise thereof. The member 40 is carried by an elongate link 42 which extends for a major part of the width of the window sash, as shown in FIG. 1. The link 42 is integral with a gear 43 which is pivotally mounted to an end of the operating arm 30 by a pivot pin 44. Pivotal movement of the operating arm 30 from the window closed position of FIG. 1 results in moving an end of the link outwardly to impart a linear component of movement to the link. The link is also caused to rotate by gear means including the gear 43.

The gear means includes a stationary gear 50 mounted to the housing 25 and formed as one quadrant of a complete circular gear and meshing with an intermediate gear 51 rotatably mounted to the operating arm 30 intermediate the ends thereof by a pin 52. The gear 43 and intermediate gear 51 are spaced from the operating arm by a pair of integral spacer members 55 and 56, respectively, to be in the same plane as the stationary gear 50.

With the described operator, the member 40 follows a curved path which is hypocycloid. This movement is a composite of movement derived from pivoting of the operator arm 30 and rotation of the link 42 by rotation of gear 43 and intermediate gear 51 with the intermediate gear 51 walking along the stationary gear 50 as the operating arm moves to its extended position and resultingly causing rotation of the gear 43 and the link 42 integral therewith. The relation of these components when the window sash is fully open is shown in broken line in FIG. 3.

The outer edge of the window sash 15 follows a curved path determined by its hinges. The hypocycloid movement of the operator causes member 40 to closely follow this path but with differences in motion permitted by movement of member 40 in channel member 41.

The member 40 exerts a push on the outer edge of the window sash in both opening and closing movements to provide an improved mechanical advantage for the operator and with the member 40 and the outer edge of the sash following the same curved path, there is very little relative movement which minimizes frictional losses in movement of the member 40 relative to the channel member 41. Additionally, the operator provides increased resistance to wind loading exerted against the window because the operator is always in operative engagement with the window sash near the outer edge thereof.

We claim:

1. An operator for a casement-type window having a sash mounted adjacent one edge thereof for combined pivoting about a pivot axis and linear movement of the sash relative to a window frame comprising, a member movably engaged with said sash adjacent an outer edge thereof remote from said one edge for imparting opening and closing force to the sash, and means including a link pivotable about an axis generally parallel with said pivot axis for moving said member in a path which closely approximates the movement of the sash outer edge to cause said member to always act adjacent said outer edge.

2. An operator as defined in claim 1 wherein said means for moving said member comprises a link carrying said member, and means for imparting simultaneous rotation and translation to said link.

3. An operator as defined in claim 2 wherein said link has said member at one end thereof and a gear fixed to the other end thereof, an operating arm mountable to the frame for pivotal movement and pivotally connected at an end to said other end of the link, and gear means for causing rotation of said gear as the operating arm pivots.

4. An operator as defined in claim 3 wherein said gear means includes a stationary gear member coaxial with the pivotal axis of said operating arm, and a gear rotatably mounted on said operating arm intermediate the ends thereof and meshing with said stationary gear and the gear fixed to said link.

5. An operator as defined in claim 1 wherein a channel member is fixed to said sash adjacent the outer edge thereof to extend lengthwise of the lower rail of the sash, and said member is a roller engaged in said channel member.

6. An operator for a casement-type window comprising, a sash mounted adjacent one edge thereof on slider structure enabling combined pivoting and linear movement of the sash relative to a window frame, a constraining link connected between the sash and frame for controlling sash movement, a member movably engaged with said sash adjacent an outer edge thereof for imparting opening and closing force to the sash, and means for moving said member in a path generally corresponding to a hypocycloid whereby said member always acts adjacent said outer edge.

7. An operator as defined in claim 6 wherein said means for moving said member includes a link having said member at one end thereof, an operating arm mounted for pivotal movement and pivotally connected to said link, and gear means for imparting pivotal movement to said link as said operating arm is pivoted.

8. An operator for a casement-type window having a window frame with a movable window sash with said sash being mounted adjacent one edge thereof for combined pivoting and linear movement of the sash relative to the frame, a channel member fixed to said sash adjacent an outer edge thereof and having a length extending lengthwise of the lower rail of the sash, an operating arm pivotally mounted on said frame, a member movable within said channel member, and drive means for said member and operable in response to pivoting of said operating arm to impart bodily movement to said member which causes said member to follow a curved path which is a hypocycloid.

9. An operator for a casement-type window having a window frame with a movable window sash with said sash being mounted adjacent one edge thereof for combined pivoting and linear movement of the sash relative to the frame, a channel member fixed to said sash adjacent an outer edge thereof and having a length extending lengthwise of the lower rail of the sash, an operating arm pivotally mounted on said frame, a member positioned within said channel member, a link pivotally connected at one end thereof to said operating arm and carrying said member at the other end thereof, a gear fixed to said link at said one end thereof, a stationary gear member coaxial with the pivotal axis of the operating arm, and a gear rotatably mounted on said operating arm intermediate ends thereof and meshing with said stationary gear and the gear fixed to said link.

* * * * *